US008894557B2

(12) United States Patent
Duwendag et al.

(10) Patent No.: US 8,894,557 B2
(45) Date of Patent: Nov. 25, 2014

(54) BAG-MAKING DEVICE

(75) Inventors: Ruediger Duwendag, Lengerich (DE); Andreas Sonntag, Muenster (DE)

(73) Assignee: Windmoller & Holscher KG, Lengerigh (DE)

( * ) Notice: Subject to any disclaimer, the term of this patent is extended or adjusted under 35 U.S.C. 154(b) by 0 days.

(21) Appl. No.: 12/923,288

(22) Filed: Sep. 13, 2010

(65) Prior Publication Data

US 2011/0124479 A1 May 26, 2011

Related U.S. Application Data

(63) Continuation of application No. 12/292,958, filed on Dec. 1, 2008, now abandoned, which is a continuation of application No. 10/531,256, filed as application No. PCT/EP03/13801 on Dec. 5, 2003, now abandoned.

(30) Foreign Application Priority Data

Dec. 20, 2002 (DE) ..... 102 61 256

(51) Int. Cl.

| | |
|---|---|
| ***B31B 19/10*** | (2006.01) |
| ***B31B 21/02*** | (2006.01) |
| ***B31B 29/00*** | (2006.01) |
| ***B31B 19/74*** | (2006.01) |

(52) U.S. Cl.

CPC ..... *B31B 19/74* (2013.01); *B31B 2221/20* (2013.01); *B31B 29/00* (2013.01); *B31B 2221/405* (2013.01); *B31B 2219/95* (2013.01)

USPC ..... 493/186; 493/196; 493/218

(58) Field of Classification Search

USPC ..... 493/186, 196, 218; 53/550; 198/470, 198/577, 781.03

See application file for complete search history.

(56) References Cited

U.S. PATENT DOCUMENTS

| | | | | | |
|---|---|---|---|---|---|
| 2,248,895 | A | * | 7/1941 | Parrish | 493/221 |
| 2,668,481 | A | * | 2/1954 | Robinson | 493/213 |
| 3,034,409 | A | * | 5/1962 | Finke et al. | 493/335 |
| 3,221,869 | A | * | 12/1965 | Fritz | 198/847 |
| 3,334,550 | A | * | 8/1967 | Charles | 493/221 |
| 3,613,523 | A | * | 10/1971 | Wesselmann | 493/221 |
| 3,672,264 | A | * | 6/1972 | Woodruff et al. | 493/206 |
| 3,793,926 | A | * | 2/1974 | Honsel | 493/246 |
| 3,834,287 | A | * | 9/1974 | Hollis | 493/317 |
| 3,913,463 | A | * | 10/1975 | Hollis | 493/256 |
| 3,926,097 | A | * | 12/1975 | Santa Maria et al. | 493/361 |
| 3,927,606 | A | * | 12/1975 | Brockmuller et al. | 493/203 |
| 4,020,724 | A | * | 5/1977 | Quinlan | 83/346 |
| 4,126,948 | A | * | 11/1978 | VerMehren | 34/616 |
| 4,159,760 | A | * | 7/1979 | Kovacs et al. | 198/418.1 |
| 4,228,728 | A | * | 10/1980 | Hollis | 493/313 |

(Continued)

*Primary Examiner* — Thanh Truong
*Assistant Examiner* — Gloria R Weeks
(74) *Attorney, Agent, or Firm* — Jacobson Holman, PLLC.

(57) ABSTRACT

A bag-making device for cross base bags limits the number of quality defects resulting from the fabrication tolerances of the conveyor belt. The device has working stations that perform working steps on bag tube sections during the bag making operation. At least one working station is equipped with a tool that is mounted on a tool roller and that runs through its working position during each rotation of the roller. The bag-making device has a conveyor system that conveys the tube sections through the working stations with conveyor belts, and a drive system that drives conveyor drive wheels and the tool rollers such that the drive wheels are driven with lesser angular speed than the tool rollers.

15 Claims, 3 Drawing Sheets

(56) References Cited

U.S. PATENT DOCUMENTS 4,261,779 A * 4/1981 Wech ..... 156/251
4,295,842 A * 10/1981 Bell ..... 493/342
4,351,432 A * 9/1982 Ballocci et al. ..... 198/847
4,406,361 A * 9/1983 Konigs et al. ..... 198/588
4,409,852 A * 10/1983 Suzuki et al. ..... 73/862.392
4,411,947 A * 10/1983 Heynhold ..... 442/228
4,432,746 A * 2/1984 DeHaan ..... 493/359
4,500,307 A * 2/1985 Bridgeman ..... 493/196
4,506,488 A * 3/1985 Matt et al. ..... 53/55
4,574,566 A * 3/1986 Eaves et al. ..... 53/450
4,657,131 A * 4/1987 Brychta et al. ..... 198/810.04
4,726,168 A * 2/1988 Seko ..... 53/450
4,747,817 A * 5/1988 Newsome ..... 493/438
4,832,677 A * 5/1989 Hudgens et al. ..... 493/369
4,842,123 A * 6/1989 Visser ..... 198/341.02
4,850,949 A * 7/1989 Dallaserra et al. ..... 493/418
4,931,031 A * 6/1990 Lisiecki ..... 493/355
4,952,202 A * 8/1990 Itoh ..... 493/299
4,955,184 A * 9/1990 Francioni ..... 53/448
5,114,392 A * 5/1992 McAdam et al. ..... 493/179
5,134,833 A * 8/1992 Lerner et al. ..... 53/468
5,164,241 A * 11/1992 Andre De La Porte et al. ..... 428/97
5,197,938 A * 3/1993 Chmielewski ..... 493/373
5,224,919 A * 7/1993 Walsh ..... 493/89
5,236,408 A * 8/1993 McAdam et al. ..... 493/355
5,259,495 A * 11/1993 Douglas ..... 198/404
5,298,007 A * 3/1994 Achelpohl et al. ..... 493/226
5,355,992 A * 10/1994 Baig et al. ..... 198/495
5,386,753 A * 2/1995 Baron et al. ..... 83/335
5,456,349 A * 10/1995 Axmann ..... 198/831
5,478,638 A * 12/1995 Springer et al. ..... 442/205
5,531,660 A * 7/1996 Biese et al. ..... 493/243
5,545,419 A * 8/1996 Brady et al. ..... 426/129
5,548,946 A * 8/1996 Holub ..... 53/550
5,609,242 A * 3/1997 Hutchins et al. ..... 198/847
5,609,556 A * 3/1997 Rostalski et al. ..... 493/226
5,697,292 A * 12/1997 Simmons ..... 99/574
5,729,959 A * 3/1998 Spatafora et al. ..... 53/450
5,879,278 A * 3/1999 Cox ..... 493/67
5,980,441 A * 11/1999 Kolbe et al. ..... 493/226
5,989,172 A * 11/1999 Achelpohl ..... 493/189
6,029,799 A * 2/2000 Weigel et al. ..... 198/810.04
6,042,526 A * 3/2000 Baumer ..... 493/218
6,059,705 A * 5/2000 Ruthenberg et al. ..... 493/11
6,059,709 A * 5/2000 Achelpohl et al. ..... 493/226
6,106,448 A * 8/2000 Obara et al. ..... 493/11
6,739,445 B2 * 5/2004 Armstrong ..... 198/435
6,991,592 B2 * 1/2006 Wold et al. ..... 493/218
7,157,873 B2 * 1/2007 Carolan ..... 318/432
8,597,167 B2 * 12/2013 Haeger et al. ..... 493/218
2002/0033320 A1 * 3/2002 Matsuoka et al. ..... 198/835
2002/0183181 A1 * 12/2002 Hayashi et al. ..... 493/194
2003/0168320 A1 * 9/2003 Itoh et al. ..... 198/809
2005/0176554 A1 * 8/2005 Schonnenbeck et al. ..... 475/343
2005/0277534 A1 * 12/2005 Duwendag et al. ..... 493/186
2009/0221409 A1 * 9/2009 Duwendag et al. ..... 493/267
2011/0124479 A1 * 5/2011 Duwendag et al. ..... 493/186
2012/0270714 A1 * 10/2012 Dieckmann et al. ..... 493/267

* cited by examiner

BAG-MAKING DEVICE

CROSS-REFERENCE TO RELATED APPLICATION

This application is a continuation application of U.S. application Ser. No. 12/292,958, filed Dec. 1, 2008, which was a continuation application of U.S. application Ser. No. 10/531,256, filed Apr. 13, 2005, the disclosures of which are incorporated by reference as if fully set forth herein. The predecessor application U.S. application Ser. No. 10/531,256 is a nationalization of PCT/EP03/013801 filed Dec. 5, 2003, and published in German.

BACKGROUND OF THE INVENTION

1. Field of Invention

The invention concerns a bag-making device for cross base bags.

2. Description of the Prior Art

These devices are known and are acknowledged, e.g., in the document DE 198 05 321 C1. In more recent times, there has been an increasing demand for cross base bags with small volumes. Cross base bags can have a small volume by means of a smaller base middle measurement. However, the manufacture of bags with smaller base middle measurement requires the implementation of extensive constructive changes in the means of production, primarily in bag making devices. Since the bags are conveyed at right angles to the principal axis of the tube through the working station of the bag-making device, both the working stations and also the conveyor system have to be formed in a narrower configuration than they have been previously.

One of the necessary measures is the use of narrower conveyor belts for conveying the bags through the working stations of the bag-making device. However, the conveyor belts are exposed to a considerable amount of tensile stress and run the risk of being stretched. This tendency increases with the decreasing breadth of the conveyor belt. The result of changing the length of the conveyor belt in the operation, however, is that the bag positions in the working stations no longer correctly align with the rotary motions of the tool rollers. The tools run through their machining position when the bag is not yet or is no longer located at the right place, and the related working step is executed inaccurately. As a result, the normal fabrication tolerances of the bags can be exceeded, resulting in serious quality defects in the bags, e.g., leakiness and lack of durability. These consequences are highly undesirable.

For these reasons the use of conveyor belts is recommended that have at least components made of tensile-stressable material such as steel. Typically these components of the belt are coated with a more elastic and softer material that prevents the conveyed items from being damaged. In this context the so-called cable cord belts may be employed that contain steel in their core and are usually coated with rubber.

Unfortunately conveyor belts of the above-described kind have fabrication tolerances that can be exceeded when the belt is stretched. The result of these fabrication tolerances is once again imprecisions in the positioning of the bags in the machining positions and thus in the fabrication tolerances of the bags.

SUMMARY OF THE INVENTION

Therefore an object of the present invention is to provide a device that restricts the quality defects that are brought about by the exceeded fabrication tolerances of the conveyor belt.

This task is solved thus:

the drive wheels of the drive system can be driven using lesser angular speed than at least a tool roller and that the drive wheels have a larger diameter than the tool rollers.

The present invention makes use of a whole series of surprising findings.

In the use of conveyor belts having components of tensile-stressable material such as steel and a softer protective covering and/or a softer coating, the conveying process of the bags is first determined by the tensile-stressable material.

Thus the angular speed of the transport discs and the distance of the tensile-stressable material from the axis of the transport discs are decisive factors for determining the conveying speed of the bags in the working stations.

The distance of the tensile-stressable material from the axis of the transport discs is referred to herein as the effective disc radius. The effective disc radius is the actual radius of the drive wheel and the thickness of the elastic, soft layer between the outer circumference of the transport disc and the tensile-stressable material. However, the thickness of this layer is subject to variations that are transferred to the effective radius of the transport discs and thus to the conveying speed.

These variations are mainly responsible for the imprecisions in the positioning of the bags in the working stations. By the measures in accordance with the invention, the relative portion of the variations in the thickness of the elastic, soft layer between the outer circumference of the transport disc and the tensile-stressable material is reduced to the effective radius of the transport disc and thus to the conveyance speed.

What proves to be particularly advantageous is a configuration in which the ratio of the angular speed of the drive wheels to the angular speed of the processing rollers is 2:3. Due to this ratio of the angular speed of 2:3, the speed droop of the conveyor belt also reduces by the factor 2:3 as compared to when the drive wheels have the same angular speed as the processing rollers.

It is advantageous to provide a drive system that with the help of a bevel gear diverges torque moment for at least one drive wheel from a line shaft (vertical shaft with bevel gears) and transfers it onto the drive wheel via a planetary gear placed underneath.

An embodiment of the configuration of the invention is presented in the drawings and the objective description.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
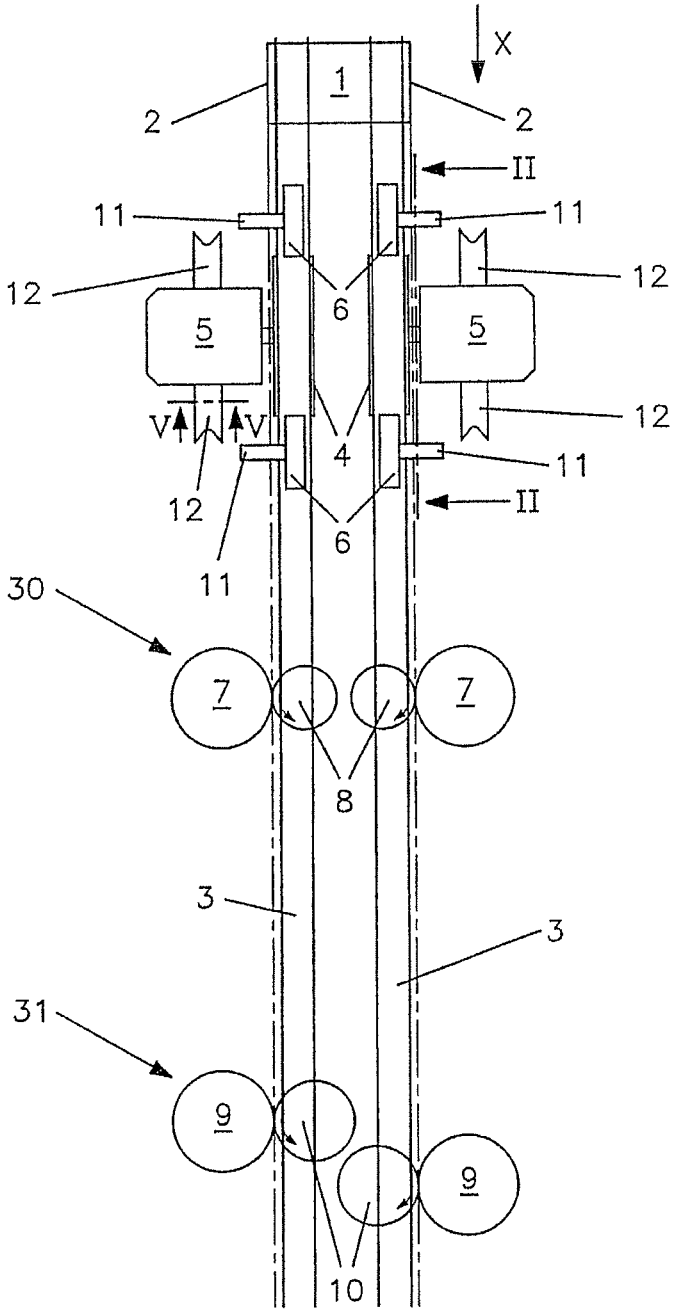
FIG. 1 top view of a cutout of a bag-making device in accordance with the invention FIG. 2 side view in accordance with II-II in FIG. 1

FIG. 1 illustrates a top view of a cutout portion of a bag-making device in accordance with the present invention. The tube sections 1 are conveyed in a laid flat mode in the conveying direction x. The base 2 of the tube sections 1 was formed in a previous operation. The formation of a bag base is described in, e.g., an unpublished patent application of the same applicant with the application number DE 102 55 483. The tube section 1 is held gripped between the conveyor belts 3. As an example of two working stations existing in a bag making device, the base grooving station 30 and the gluing station 31 are described in the following. The tools designed as grooving knives that are attached on the circumference of the grooving rollers 7 of the base grooving station 30, provide the bases 2 of the tube section 1 with a base grooving whereby the back pressure rollers 8 provide the counteracting force. Subsequently an adhesive application in accordance with the format takes place in the gluing station 31 on the bases 2 of the tube sections 1 by the format rollers 9. The back pressure rollers 10 provide the counteracting force required for the adhesive application. All the rollers 7, 8, 9, 10 are supported in a manner that is not illustrated in detail in the machine frame (also not illustrated).

Figure 2:
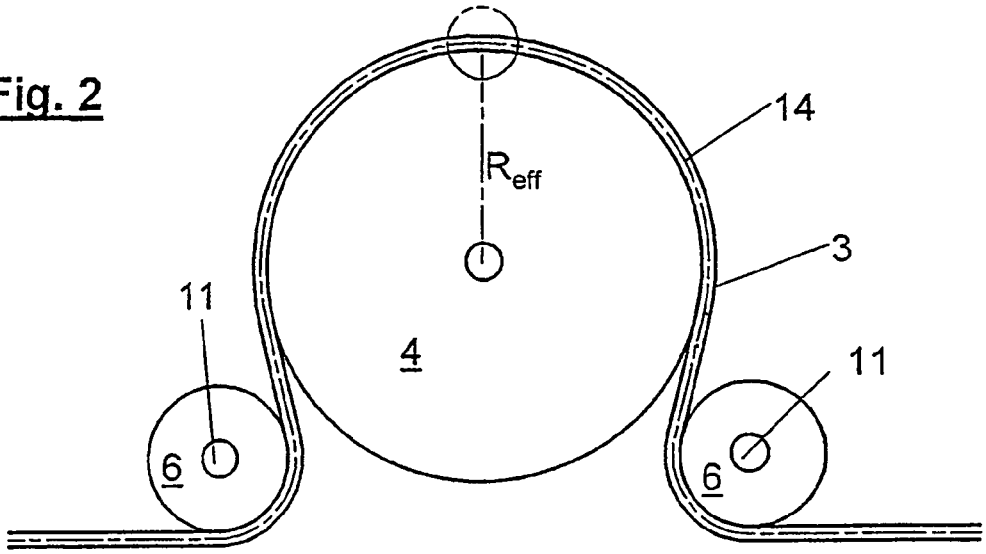

The conveyor belt 3 is designed as an endless conveyor and entwines deflection rollers at both the ends of the bag-making device. The drive of the conveyor belt 3 takes place by the drive wheels 4. These are driven by the gears 5 that start from the line gear 12 and that are described in more detail on the basis of FIG. 5. In order to guarantee a sufficient adhesion of the conveyor belt 3 on the drive wheel 4, a deflection disc 6 is arranged to the right and the left of each drive wheel 4 as can be seen in FIG. 2. These deflection discs 6 are pivoted over their bearing pins 11 in the machine frame.

The speed of the conveyor belt 3 and also the conveying speed of the tube sections 1 result from the distance covered per time unit. The distance covered, however, depends on the distance between the steel cord 13 (FIG. 3) of the conveyor belt 3 and the axis of the drive wheel 4. This distance is referred to herein as the effective radius "$R_{eff}$." The effective radius $R_{eff}$ is the sum of the radius of the drive wheel 4 and the thickness D of the rubber coat 15 between the steel cord 13 and the surface 17 of the conveyor belt 3. The surface 17 is in direct contact with the outer circumference of the drive wheel 4.

Figure 3:
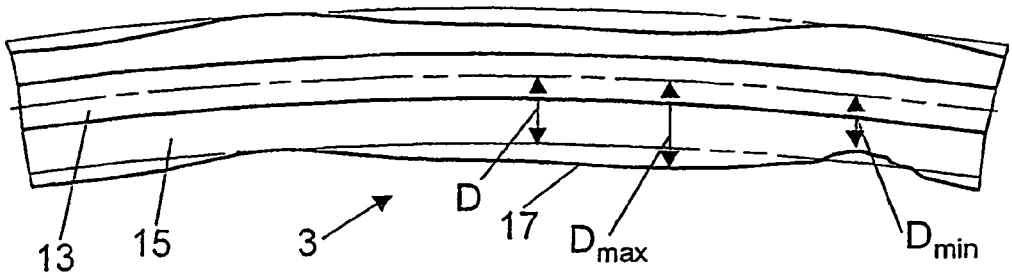
FIG. 3 detailed view of the area circled in FIG. 2

As can be seen in FIG. 3 the thickness D has no constant value, and instead it varies between the values "$D_{min}$" and "$D_{max}$." In other words, the distance D is afflicted with an error $\Delta D$ that results from the difference between $D_{max}$ and $D_{min}$. This error that results from the fabrication tolerances of the conveyor belt directly causes speed droops of the conveyor belt 3 and thus deficiencies in the fabrication quality of the cross base bags.

The present invention is particularly advantageous in that it provides a configuration in which the ratio of the angular speed of the drive wheels 4 to the angular speed of the processing rollers 7, 9 is 2:3. By virtue of this ratio of the angular speed being 2:3, the speed droop of the conveyor belt 3 reduces accordingly by the factor of 2:3 as compared to a configuration in which the drive wheels 4 have the same angular speed as the processing rollers 7, 9.

Figure 4:
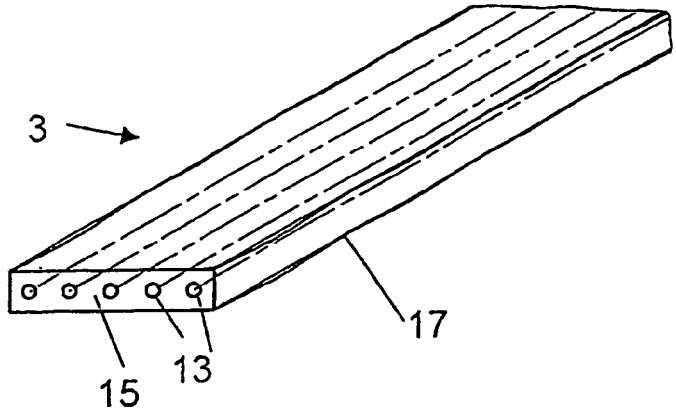
FIG. 4 detailed view of a conveyor belt

FIG. 4 illustrates a perspective view of the structure of the conveyor belt 3. The conveyor belt 3 essentially consists of several steel cords 13 that are arranged in a horizontal plane and a rubber coat 15 that surrounds the steel cords 13. Since the steel cords 13 have an essentially higher tensile strength as compared to the rubber coat 15, the steel cords 13 determine the so-called "neutral phase" of the conveyor belt 3. This means that the steel cords 13 can neither be compressed nor can they be stretched. Conveyor belts 3 with a structure of such type are referred to in technology nomenclature as "cable cord belts" and can be kept narrow due to their tensile strength. These conveyor belts 3 are thus particularly suitable for use in bag making devices that are used to manufacture cross base bags with a small base middle measurement. While using conveyor belts with a lower specific tensile strength, these bag making devices would have to be designed broader in order to receive a comparable tensile strength. The minimum base middle measurement that must be maintained increases accordingly.

Figure 5:
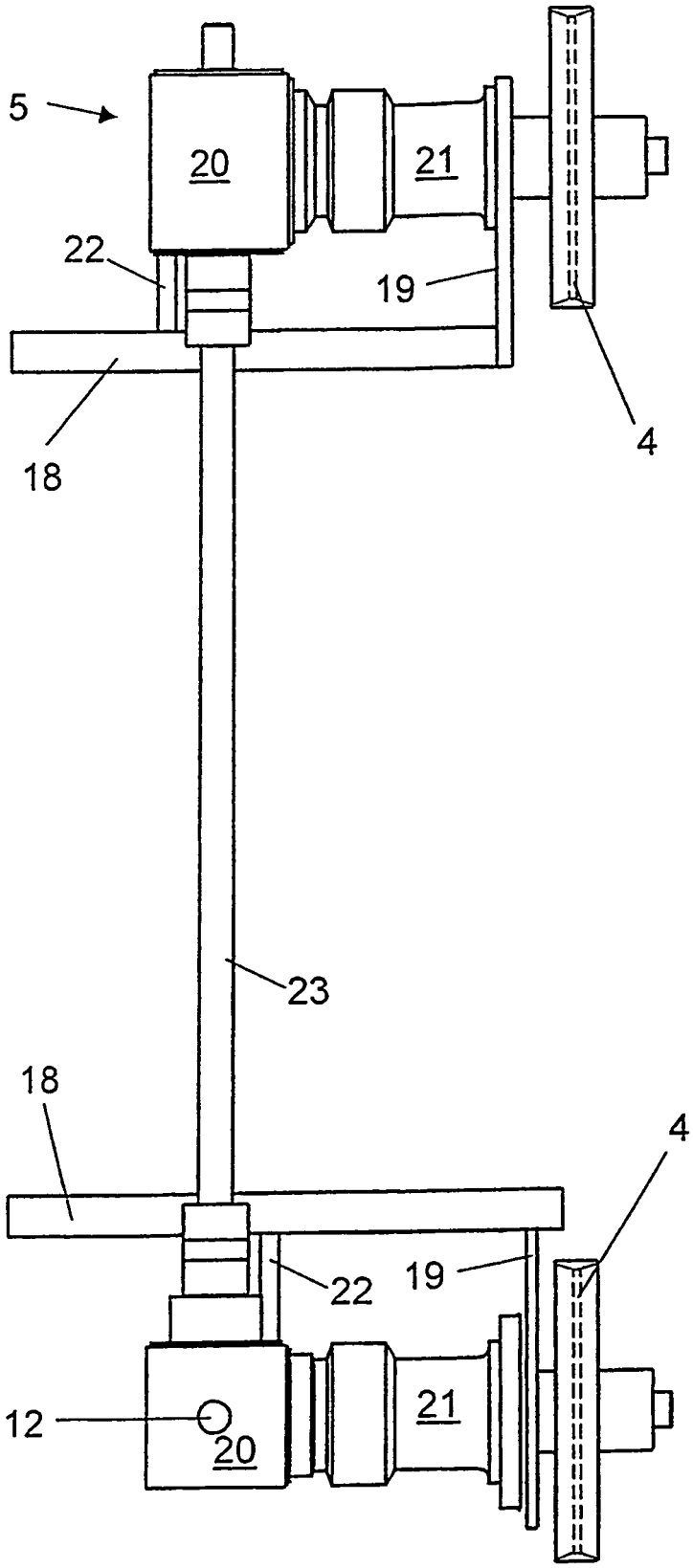
FIG. 5 gear configuration for the drive wheels in a bag-making device in accordance with the invention.

FIG. 5 illustrates a view of the gear 5 in accordance with FIG. 1. The drive torque is fed to the gear via the line gear 12. The shaft 23 pushes a bevel gear 20 that takes off a part of the torque moment and distributes it onto the planetary gear 21 and the shaft 23. The shaft 23 ends in another bevel gear 20 that deviates the torque moment and delivers it to another planetary gear 21. Both the planetary gears 21 each drive a drive wheel 4. All the gearbox parts 20, 21, 23 are connected to the base plates 18 or to the retaining plates 19, 22 whereby the retaining plates 19, 22 also are firmly connected to the base plates 18. The base plates 18 are attached to the machine frame in a manner not illustrated herein in more detail.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference symbols | |
|---|---|
| 1 | Tube section |
| 2 | Base |
| 3 | Conveyor belt |
| 4 | drive wheel |
| 5 | Gear |
| 6 | Deflection disc |
| 7 | Grooving roller |
| 8 | Back pressure roller |
| 9 | Format roller |
| 10 | Back pressure roller |
| 11 | Bearing pin |
| 12 | line gear |
| 13 | Steel cord |
| 15 | Rubber coat |
| 17 | Surface of the rubber coat 15 |
| 18 | Base plate |
| 19 | Retaining plate |
| 20 | Bevel gear |
| 21 | Planetary gear |
| 22 | Retaining plate |
| 23 | shaft |
| 30 | Base grooving station |
| 31 | Gluing station |
| $R_{eff}$ | Effective radius |
| D | Thickness of the rubber layer |
| $D_{min}$ | Minimum thickness of the rubber layer |
| $D_{max}$ | Maximum thickness of the rubber layer |
| x | Conveying direction |

What is claimed is:

1. A bag making device for cross base bags in which tube sections for the bags are processed, comprising:

a plurality of working stations that perform different working steps on the tube sections, at least one of the working stations being equipped with a tool that is mounted on a tool roller and that passes through a working position associated therewith during each rotation of the tool roller, at least one conveyor system that conveys the tube sections through the working stations, the conveyor system including cable cord belts that are driven by drive wheels having a larger diameter than the tool roller, and a drive system that drives the drive wheels and the tool roller such that one tube section passes through the at least one working station each time the tool roller completes a rotation and such that an angular speed of the drive wheels is less than an angular speed of the tool roller;

wherein the drive wheels are driven by a transfer of torque from a line gear in communication with a bevel gear that is in communication with a planetary gear that is in communication with the drive wheel.

2. The bag making device in accordance with claim 1, wherein a ratio of the angular speed of the drive wheels to the angular speed of the tool roller is 2:3 so that loss of tension associated with elongation of the cable cord belt during operation is reduced.

3. A method of processing tube sections in cross base bags, comprising:

performing working steps on the tube sections in a plurality of working stations including in at least one working station performing a working step with a tool that is mounted on a rotating tool roller and that passes through a working position associated therewith once during each rotation of the roller;

conveying the tube sections through the working stations with cable cord belts that are driven by drive wheels; and driving the drive wheels with less angular speed than the tool roller such that one tube section passes through at least one working station each time the tool roller completes a rotation.

4. The method in accordance with claim 3, wherein a ratio of the angular speed of the drive wheels to the angular speed of the tool roller is 2:3.

5. A bag making device for processing a tube section of a cross base bag, comprising:

a station that performs a processing step on the tube section, the station having a tool that is mounted on a rotating tool roller such that the tool passes through a processing position during each rotation of the tool roller;

a conveyor system that conveys the tube section through the station, the conveyor system including a cable cord belt that is driven by a drive wheel having a larger diameter than a diameter of the tool roller; and a drive system that drives the drive wheel and the tool roller such that the tube section passes through the station each time the tool roller completes a rotation and such that a ratio of an angular speed of the drive wheel to an angular speed of the tool roller is 2:3.

6. The device according to claim 5, further comprising a plurality of the stations that each performs a processing step on the tube section, and a corresponding plurality of tools mounted on a corresponding plurality of tool rollers.

7. The device according to claim 5, further comprising a pair of deflection wheels associated with the drive wheel, the deflection wheels providing tension on the cable cord belt so as to provide adhesion between the cable cord belt and the drive wheel.

8. The device according to claim 5, wherein the cable cord belt includes a plurality of tensile-stressable metal cords arranged in a horizontal plane and an elastic coating that surrounds the cords.

9. The device according to claim 8, wherein the metal cords have a higher tensile strength than the elastic coating.

10. The device according to claim 8, wherein the elastic coating is rubber.

11. The device according to claim 8, wherein the cable cord belt has a width that is less than a width of a conveyor belt without the plurality of tensile-stressable metal cords.

12. The device according to claim 5, wherein the drive wheel is driven by a partial transfer of torque from a line shaft in communication with a bevel gear that is in communication with a planetary gear that is in communication with the drive wheel.

13. The device according to claim 5, wherein the cable cord belt includes a plurality of incompressible and nonstretchable metal cords (i) extending longitudinally and substantially parallel to each other throughout a length of the cable cord belt and (ii) being provided in a spaced configuration across a width of the cable cord belt.

14. A bag making device for processing a tube section of a cross base bag, comprising:

a station that performs a processing step on the tube section, the station having a tool that is mounted on a rotating tool roller such that the tool passes through a processing position during each rotation of the tool roller;

a conveyor system that conveys the tube section through the station, the conveyor system including a cable cord belt that is driven by a drive wheel having a larger diameter than a diameter of the tool roller, the cable cord belt including a plurality of incompressible and nonstretchable metal cords (i) extending longitudinally and substantially parallel to each other throughout a length of the cable cord belt and (ii) being provided in a spaced configuration across a width of the cable cord belt; and a drive system that drives the drive wheel and the tool roller such that the tube section passes through the station each time the tool roller completes a rotation and such that a ratio of an angular speed of the drive wheel to an angular speed of the tool roller is 2:3.

15. The bag making device according to claim 14, wherein the metal cords are arranged in a horizontal plane of the cable cord belt, and wherein a rubber coating surrounds the metal cords, the metal cords having a higher tensile strength than the rubber coating.

* * * * *